US006232283B1

(12) United States Patent
Inoue et al.

(10) Patent No.: US 6,232,283 B1
(45) Date of Patent: May 15, 2001

(54) LIQUID DETERGENT COMPOSITION

(75) Inventors: Takumi Inoue; Kazunori Tsukuda; Mitsuru Uno; Noriyuki Morii, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/330,060

(22) Filed: Jun. 11, 1999

(51) Int. Cl.[7] ..... C11D 3/20

(52) U.S. Cl. ..... 510/405; 510/180; 510/181; 510/191; 510/188; 510/195; 510/238; 510/243; 510/245; 510/505; 510/506; 510/509; 510/527

(58) Field of Search ..... 510/180, 181, 510/188, 191, 195, 238, 243, 245, 405, 505, 506, 509, 527

(56) References Cited

U.S. PATENT DOCUMENTS

| | | | | |
|---|---|---|---|---|
| 2,157,022 | * | 5/1939 | Schrauth | 510/130 |
| 2,900,346 | * | 8/1959 | Fowkes et al. | 510/497 |
| 4,098,713 | * | 7/1978 | Jones | 510/351 |
| 4,206,070 | * | 6/1980 | Jones | 510/345 |
| 4,544,498 | * | 10/1985 | Suzuki | 523/171 |
| 6,008,183 | * | 12/1999 | Morioka et al. | 510/506 |

FOREIGN PATENT DOCUMENTS

| | | |
|---|---|---|
| 7-3289 | 1/1995 | (JP) . |
| 9-310091 | 12/1997 | (JP) . |
| 9-310098 | 12/1997 | (JP) . |
| 10-21929 | 1/1998 | (JP) . |

* cited by examiner

*Primary Examiner*—William Krynski
*Assistant Examiner*—Dawn L. Garrett
(74) *Attorney, Agent, or Firm*—Oblon, Spivak, McClelland, Maier & Neustadt, P.C.

(57) ABSTRACT

The present invention provides a liquid detergent composition having high detergency without damaging styrene-based resin.

The liquid detergent composition comprising (a) 0.1 to 50% by weight of a mixture of at least two different compounds from each other in view of their strutural isomers and/or their number of carbon atoms, selected from glyceryl-ether compounds having the formula (I): $R—OCH_2CH(OH)CH_2OH$ (I) wherein R is an alkyl or alkenyl group having 1 to 11 carbon atoms; (b) 0.01 to 30% by weight of a surfactant; (c) 0.01 to 30% by weight of a builder or an alkali agent; and (d) the balance of water.

17 Claims, 1 Drawing Sheet

Drawings

LIQUID DETERGENT COMPOSITION

TECHNICAL FIELD

The present invention relates to a liquid detergent composition having excellent detergency towards oil smears and soap scums and hardly damaging base materials, which is particularly suitable as a detergent for use in kitchens, bathrooms, and toilets and as a detergent for living smears.

PRIOR ART

To remove smears which are different depending on treated subjects such as bathrooms, kitchens, floors etc., detergents generally having compositions adapted to each of the smears have been used. Besides detergency, there is further demand for not causing damage to base materials as subjects to be cleaned. For example, if base materials such as styrene-based resin e.g. ABS resin recently used widely as a material for various structures, or base materials using the styrene-based resin in combination with other materials such as metal, glass etc., are cleaned, they may be damaged depending on a solvent to be added to the detergent.

The object of the present invention is to provide a liquid detergent composition not damaging various base materials, particularly plastic base materials represented by the styrene-based resin and simultaneously being capable of demonstrate high detergency towards various smears, particularly denatured-oil smears and soap scums.

The present inventors have previously proposed a detergent composition for hard surfaces comprising a specific range of glyceryl-ether solvents incorporated therein as a detergent applicable to a wide variety of uses in order to solve the cumbersome selection of detergents for each use (JP-A 7-3289).

DISCLOSURE OF INVENTION

To cope with diversification of materials, the present inventors made extensive studies based on the detergent composition disclosed in JP-A 7-3289, and as a result, the present inventors have found that a composition obtained by incorporation of a specific combination of glyceryl-ethers in place of the glyceryl-ethers used in the prior art composition can have improved detergency without damaging base materials, and the present invention has thereby been completed.

That is, the present invention provides a liquid detergent composition comprising:

(a) 0.1 to 50% by weight of a mixture of at least two different compounds from each other in view of their structural isomers and/or the number of carbon atoms included therein, selected from glycery-ether compounds having the formula (I):

$$R—OCH_2CH(OH)CH_2OH \quad (I)$$

wherein R is an alkyl or alkenyl group having 1 to 11 carbon atoms, (b) 0.01 to 30% by weight of a surfactant, (c) 0.01 to 30% by weight of a builder or an alkali agent and (d) the balance of water.

MODE FOR CARRYING OUT THE INVENTIONS

The glyceryl-ether mixture as component (a) used in the present invention is at least one mixture which satisfies the condition represented by (i) or (ii):

(i) a mixture of glyceryl-ethers represented by formula (I), and wherein the glyceryl-ethers having a alkyl or alkenyl group (i.e. R) having different carbon-atoms-number from each other;

(ii) structural isomers represented by the formula (I). In particular, the mixture of glyceryl-ethers is preferably a mixture of 2 or more.

The mixed ratio of glyceryl-ethers is preferable in the range from 1:9 to 9:1, especially preferable in the range from 2:8 to 8:2 and more preferable in the range from 3:7 to 7:3.

As the condition (i), Rs to be mixed are different from each other, and then R is preferable to be an alkyl group having 3 to 8 carbon atoms, and especially preferable to be having 4 to 6 carbon atoms. As the condition (ii), Rs are different from each other, since Rs are structural isomers each other. Among them, Rs to be mixed is preferable to combine a liner alkyl group, a methyl branched-alkyl group and/or an ethyl-branched group, especially preferable to combine two or more selected from these members, and particularly preferable to combine a liner alkyl group with a methyl-branched alkyl group or a liner alkyl group with an ethyl-branched alkyl group. As the condition (iii), it is preferable to combine glyceryl-ethers of (i) and (ii).

The best combination is a glyceryl-ether having 4 to 6 carbon atoms or a mixture thereof satisfying the condition (ii).

The glyceryl-ether as component (a) can be obtained for example by adding 1-chloro-2,3-epoxypropane to an alcohol corresponding to R in the presence of a Lewis acid catalyst, then ring-opening the product under alkaline conditions, and ring-opening the epoxy ring by hydrolysis.

To give sufficient detergency and to improve stability in an aqueous system, the content of the component (a) in the liquid detergent composition is in the range of 0.1 to 50% by weight, preferably 0.5 to 30% by weight, more preferably 1 to 20% by weight.

The surfactant as component (b) used in the present invention includes anionic surfactants, nonionic surfactants, amphoteric surfactants and cationic surfactants.

The anionic surfactants used may be those described in JP-A 9-310091, page 8, column 13, line 41 to page 9, column 15, line 49, among which preferably used are a straight-chain alkyl benzene sulfonic acid with a $C_8$ to $C_{22}$ alkyl chain, polyoxyethylene alkyl ether sulfuric acid to which 1 to 10 moles of ethylene oxide on average have been added, a polyoxyethylene alkyl ether carboxylic acid to which 1 to 10 moles of ethylene oxide on average have been added, and a polyoxyethylene alkyl amide ether carboxylic acid to which 1 to 10 moles of ethylene oxide on average have been added, as well as salts thereof with potassium, sodium, magnesium and alkanol amine.

The nonionic surfactants used may be those described in JP-A 9-310091, page 6, column 10, line 35 to page 8, column 13, line 40, among which preferably used are a polyoxyethylene alkyl ether having a $C_8$ to $C_{22}$ alkyl chain to which 1 to 30 moles of ethylene oxide on average have been added, a polyoxyethylene oxypropylene alkyl ether to which 1 to 30 moles in average of ethylene oxide and 1 to 10 moles on average of propylene oxide have been added, a fatty acid alkanol amide with 8 to 22 carbon atoms on average or a derivative thereof to which 1 to 3 ethylene oxide (or propylene oxide) molecules on average have been added, an alkyl amine oxide with a long-chain $C_8$ to $C_{22}$ alkyl group which may have an amide linkage therein, and an alkyl polyglycoside with a $C_8$ to $C_{22}$ alkyl chain whose sugar has an average condensation degree of 1.0 to 2.0.

The amphoteric surfactants used may be those described in JP-A 9-310091, page 6, column 9, line 1 to column 10, line 34, among which mention can be made of alkanoyl amide propyl-N,N-dimethyl glycine betaine, alkanoyl amide propyl-N,N-dimethyl-2-hydroxypropyl sulfobetaine, alkyl-N,N-dimethyl glycine betaine, alkanoyl amide propyl-N,N-dimethyl-propyl sulfobetaine, lauryl-N,N-dimethyl-2-hydroxypropyl sulfobetaine etc. Among these, lauroyl amide propyl-N,N-dimethyl glycine betaine, myristoyl amide propyl-N,N-dimethyl glycine betaine, cocamide propyl-N,N-dimethyl glycine betaine, lauryl-N,N-dimethyl-2-hydroxypropyl sulfobetaine, lauroyl amide propyl-N,N-dimethyl-2-hydroxypropyl betaine etc. are preferable in respect of detergency and foaming ability.

The cationic surfactants used may be cationic surfactants described in JP-A 9-310091, page 3, column 4, line 11 to page 5, column 8, line 50, and particularly preferably used in the case of quaternary salts are $C_6$ to $C_{24}$ long-chain di-alkyl dimethyl ammonium salts, long-chain mono-alkyl monobenzyl dimethyl ammonium salts and long-chain mono-alkyl trimethyl ammonium salts, all of which may have amide or ester linkages therein, and the counter ions are preferably halogen atoms such as chlorine and bromine atoms, sulfates, and alkyl group-containing sulfate residues such as methyl- and ethyl-sulfuric acid. Cationic surfactants of amine type include long-chain di-alkyl monomethyl amine salts with a long-chain $C_8$ to $C_{24}$ alkyl group which may have an amide or ester linkage therein, preferably in the form of hydrochlorides, sulfates or phosphates.

In the present invention, the cationic surfactant can be incorporated to further improve detergency. The content of the cationic surfactant in the whole of the surfactant is preferably in the range of 5 to 80% by weight, and the content thereof in the composition is preferably 0.01 to 20% by weight, more preferably 0.1 to 10% by weight.

For sufficient detergency, the content of the component (b) in the liquid detergent composition is in the range of 0.01 to 30% by weight, preferably 0.05 to 20% by weight, more preferably 0.1 to 10% by weight.

As the component (c) in the present invention, it is possible to employ alkylglycine-N,N-diacetic acid, aspartic acid-N,N-diacetic acid and serine-N,N-diacetic acid described in JP-A 9-310091, JP-A9-310098, JP-A 10-21929 etc., L-glutamic acid diacetic acid and (S,S)-ethylene diamine disuccinic acid. However, it is preferable to employ hydroxycarboxylic acids such as citric acid and malic acid, dicarboxylic acids such as succinic acid and malonic acid, condensed phosphoric acids such as pyrophosphoric acid, phosphoric acids such as ethane-1hydroxy-1,1-diphosphoric acid, aminotri(methylphosphoric acid), ethylene diamine tetra(methylenephosphoric acid) and aminocarboxylic acids such as ethylenediamine tetraacetic acid, nitrilotriacetic acid, hydroxyethyl ethylene diamine triacetic acid, and alkali metal salts thereof such as sodium salts potassium salt thereof, ammonium salts thereof, alkanolamine salts thereof and water-soluble salts thereof.

For sufficient detergency, the content of the builder as the component (c) is preferably 0.1 to 20% by weight, particularly preferably 0.5 to 10% by weight.

Preferable examples of the alkali agent as component (c) are hydroxides such as sodium hydroxide, potassium hydroxide, calcium hydroxide and the like, carbonates such as sodium carbonate, potassium carbonate, sesqui-sodium carbonate (sodium sesquicarbonate) and the like, silicates such as sodium silicate, potassium silicate and the like, alkanol amines such as monoethanol amine, 2-amino-2-methyl-1-propanol and the like, as well as morpholine, N-ethyl morpholine and ammonia. Particularly preferable among these are sodium hydroxide, potassium hydroxide, sodium carbonate, potassium carbonate, monoethanol amine, diethanol amine, 2-amino-2-methyl-1-propanol, morpholine and ammonia.

For detergency, the content of the alkali agent as the component (c) is preferably in the range of 0.1 to 20% by weight, more preferably 0.5 to 10% by weight.

Other components than those described above can be added to the liquid detergent composition of the present invention in such a degree as to satisfy the object of the present invention. In particular, ethanol, ethylene glycol or propylene glycol is preferably contained to improve phase stability, and a lower alkyl benzene sulfonate such as benzene sulfonate, toluene sulfonate, xylene sulfonate or cumene sulfonate is preferably added as a low-temperature stabilizer, and 3,5-di-tert-butyl-4-hydroxy toluene, 2,5-di-tert-butyl hydroquinone, or DL-α-tocopherol is preferably added as an anti-oxidant. In particular, perfumes, coloring materials (dyes) and preservatives can be mentioned as essential ingredients in products.

Along with the above components, water is added to the liquid surfactant composition of the present invention. Water is added in such an amount to adjust the total amount to 100% by weight. Further, the liquid surfactant composition of the present invention is preferably adjusted to the range of pH 3 to 13 to improve detergency. This adjustment can be conducted with aqueous sodium hydroxide, potassium hydroxide or hydrochloric acid.

Although the liquid surfactant composition of the present invention can be applied to a wide variety of uses, it is particularly preferable as a surfactant composition used for hard bodies. The term "hard bodies" refers to bodies which whether plane or steric, maintain their predetermined shape, and their hardness is not limited insofar as they can be treated with the surfactant. The hard bodies includes not only those fixed such as floors, stairs, walls etc. made of plastics, rubbers, metals, tiles, bricks, concretes, cements, glasses, woods etc. but also a wide variety of articles made thereof such as instruments, tools, equipment, furniture, tableware etc. which a man touches. Accordingly, the liquid detergent composition of the present invention can be used as a detergent for use in kitchens, in bathrooms, for floors, for tableware, for automatic washing machines, for drainaging pipes, and for small articles in kitchens and lavatories, etc.

EXAMPLES

Examples 1 to 16, and Comparative Examples 1 to 12

The components shown in Tables 1 to 2 were used so that in Examples 1 to 8 and Comparative Examples 1 to 6, liquid detergent compositions for use around a stove were prepared, and in Examples 9 to 16 and Comparative Examples 7 to 12, liquid detergent compositions for bathtubs were prepared. The pH adjustment was conducted using sodium hydroxide or hydrochloric acid. The glyceryl-ether used as component (a) was a mixture of Compounds 1 to 5 below. Further, in Tables, p is an average number added, and Cn is an alkyl group having carbon atoms whose number is n.

Compound 1

$CH_3CH_2CH_2CH_2CH_2—CH_2CH(OH)CH_2OH$

Compound 2

$CH_3CH(CH_3)CH_2CH_2—OCH_2CH(OH)CH_2OH$

Compound 3

$CH_3CH_2CH(CH_3)CH_2—OCH_2CH(OH)CH_2OH$

Compound 4

$CH_3CH_2CH_2CH_2—OCH_2CH(OH)CH_2OH$

Compound 5

$CH_3CH_2CH_2CH_2CH_2CH_2—OCH_2CH(OH)CH_2OH$

The respective liquid detergent compositions were examined for their property of damaging a base material (property of damaging ABS resin) in the evaluation method (1) described below. Further, the liquid detergents for use around ranges were examined for their detergency towards oil smears and the liquid detergents for use in bathtubs were examined for their detergency towards soap scums, according to the evaluation methods (2) and (3) described below. The results are shown in Tables 1 to 2.

Evaluation Method (1)

<Property of Damaging ABS Resin>

Figure 1:
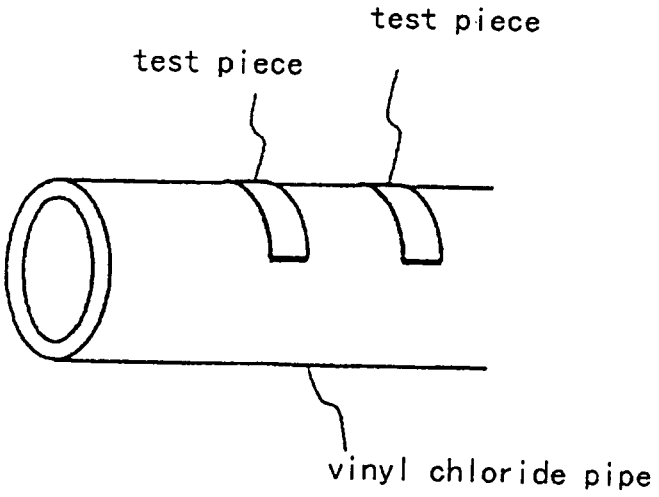
FIG. 1 shows perspective view for illustrating a method of a base-material damage test.
Figure 2:
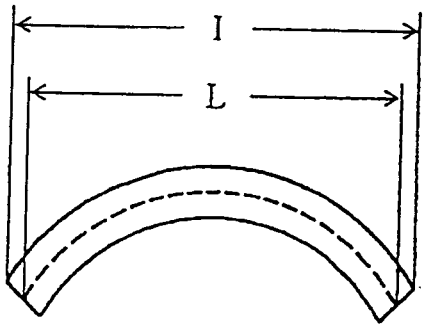
FIG. 2 shows sectional view of an ABS resin test piece for illustrating a method of a base-material damage test.

An ABS resin (Mitsubishi Monsanto Co., Ltd.) test piece of 230×35×2 mm in size was prepared. This test piece fitted to the surface shape of a vinyl chloride pipe of 276 mm in diameter and fixed as shown in FIG. 1, and it was distorted (0.74% degree of distortion) as shown in FIG. 2. This degree of distortion was determined using the following equation: degree of distortion (%)=(I−L)×100/L wherein I and L are defined in FIG. 2. Then, the thus distorted (i.e. stressed) test piece was wiped by rubbing it 10 times with a commercial tissue-paper (1 g on a dry-weight basis) impregnated with 1.7 g of the liquid detergent composition. Thereafter, the test piece was left at 20° C. under 65% RH for 24 hours, and the state of its surface was examined visually, and the damaging property of the composition was evaluated in the following criteria.

○: Not abnormal.

×: Cracked.

Evaluation Method (2)

<Detergency Towards Oil Smears>

After 10 g of cooking oil (frying oil) was applied uniformly onto an iron plate and baked at a temperature of 180° C. for 30 minutes and further left at room temperature for 3 months to form an almost dried film as a smeared plate. About 0.5 ml liquid detergent composition was dropped to the smeared plate fixed horizontally and was left for 1 minute. Thereafter, the floating smears were removed lightly with absorbent cotton. This operation was conducted 20 times in total, and the degree of each cleaning was examined visually and evaluated in the following criteria, and the average of 20 measurements was shown.

5: Complete cleaning

4: About 80% cleaning

3: About 60% cleaning

2: About 50% cleaning

1: About 30% cleaning

0: No cleaning

Evaluation Method (3)

<Detergency for Soap Scums>

A washbowl (made of polypropylene) having soap scums thereon after 3-month actual use was rubbed 5 times with a polyurethane sponge impregnated with the liquid detergent for evaluation with an about 500 g load. This operation was conducted 20 times in total, and the degree of cleaning was examined visually and evaluated in the following criteria, and the average of 20 measurements was shown.

5: Very excellent cleaning

4: Excellent cleaning

3: Incomplete cleaning

2: Slight cleaning

1: Little cleaning

TABLE 1

| | Examples | | | | | | | | Comparative Examples | | | | | |
|---|---|---|---|---|---|---|---|---|---|---|---|---|---|---|
| | 1 | 2 | 3 | 4 | 5 | 6 | 7 | 8 | 1 | 2 | 3 | 4 | 5 | 6 |
| Compound 1 (n-C5) | 3 | | 3 | | | | | 2 | | | | | | |
| Compound 2 (3i-C5) | 3 | 3 | | | 1 | 5 | | | 6 | | | | | |
| Compound 3 (2i-C5) | | 3 | 3 | | 5 | 1 | 4 | | | | | | | |
| Compound 4 (n-C4) | | | | 4 | | | 1 | 2 | | 6 | | | | |
| Compound 5 (n-C6) | | | | 2 | | | 1 | 2 | | | 6 | | | |
| Diethylene glycol butyl ether | | | | | | | | | | | | 6 | 6 | |
| Dipropylene glycol ethyl ether | | | | | | | | | | | | | | 6 |
| Alkyl (C14) amine oxide | 2 | 2 | 2 | 2 | 2 | | 2 | 2 | 2 | 2 | 2 | 2 | | |
| Fatty acid (C12) diethanol amide | 1 | 1 | 1 | 1 | | | 1 | 1 | 1 | 1 | 1 | 1 | 2 | 2 |
| Decyl maltoside | 1 | 1 | 1 | 1 | 1 | | 1 | | 1 | 1 | | 1 | | |
| Polyoxyethylene (p = 4) lauryl ether sulfuric acid sodium salt | | | | | | 1 | | 1 | | | 1 | | | |
| Sodium laurate | | | | | 1 | 1 | | | | | | | 1 | 1 |
| Cocamide propyl —N,N— dimethyl glycine betaine | | | | | | 2 | | | | | | | 1 | 1 |
| Monoethanol amine | | 5 | 5 | 5 | | 5 | | 5 | | | 5 | | | 5 |
| 2-amino-2-methyl-1-propanol | 5 | | | | | | 5 | | 5 | 5 | | 5 | | |
| Sodium hydroxide | | | | | 3 | -3 | | | | | | | | |
| Water | balance | balance | balance | balance | balance | balance | balance | balance | balance | balance | balance | balance | balance | balance |

TABLE 1-continued

| | Examples | | | | | | | | Comparative Examples | | | | | |
|---|---|---|---|---|---|---|---|---|---|---|---|---|---|---|
| | 1 | 2 | 3 | 4 | 5 | 6 | 7 | 8 | 1 | 2 | 3 | 4 | 5 | 6 |
| PH | 12 | 12 | 12 | 12 | 13 | 12 | 12 | 12 | 12 | 12 | 12 | 12 | 13 | 12 |
| (2)Oil smear detergency | 5.0 | 5.0 | 5.0 | 5.0 | 5.0 | 5.0 | 5.0 | 5.0 | 4.2 | 3.9 | 4.7 | 3.2 | 3.3 | 3.0 |
| (1)ABS base material damaging property | ○ | ○ | ○ | ○ | ○ | ○ | ○ | ○ | ○ | ○ | ○ | X | X | X |

TABLE 2

| | Examples | | | | | | | | Comparative Examples | | | | | |
|---|---|---|---|---|---|---|---|---|---|---|---|---|---|---|
| | 9 | 10 | 11 | 12 | 13 | 14 | 15 | 16 | 7 | 8 | 9 | 10 | 11 | 12 |
| Compound 1 (n-C5) | 3 | | 3 | | | | | 3 | | | | | | |
| Compound 2 (3i-C5) | 3 | 3 | | | 3 | 6 | | | 6 | | | | | |
| Compound 3 (2i-C5) | | 3 | 3 | | 6 | 3 | 5 | | | | | | | |
| Compound 4 (n-C4) | | | | 4 | | | 2 | 3 | | 6 | | | | |
| Compound 5 (n-C6) | | | | 2 | | | 2 | 3 | | | 6 | | | |
| Diethylene glycol butyl ether | | | | | | | | | | | | 6 | 6 | |
| Dipropylene glycol ethyl ether | | | | | | | | | | | | | | 6 |
| Alkyl (C14) amine oxide | 2 | 2 | 2 | 2 | 1 | | 2 | 2 | 2 | 2 | 2 | 2 | | |
| Fatty acid (C12) monoethanol amide | 1 | 1 | 1 | 1 | 1 | | 1 | 1 | 1 | 1 | 1 | 1 | 2 | 2 |
| Decyl maltoside | | | | | 2 | | 1 | | | | | | | |
| Polyoxyethylene (p = 4) lauryl ether sulfuric acid sodium salt | 1 | 1 | 1 | 1 | | 1 | | 1 | 1 | 1 | 1 | 1 | | |
| Sodium laurate | | | | | | 1 | | | | | | | 1 | 1 |
| Cocamide propyl —N,N— dimethyl glycine betaine | | | | | | 2 | | | | | | | 1 | 1 |
| EDTA-4 Na | 2 | 2 | 2 | 2 | 3 | 3 | 3 | | 2 | 2 | 2 | 2 | 2 | 2 |
| Citric acid | 3 | 3 | 3 | 3 | | | | 5 | 3 | 3 | 3 | 3 | 3 | 3 |
| Water | balance | balance | balance | balance | balance | balance | balance | balance | balance | balance | balance | balance | balance | balance |
| PH | 7 | 7 | 7 | 7 | 7 | 9 | 7 | 6 | 7 | 7 | 7 | 7 | 7 | 7 |
| (3) used-soap smear detergency | 5.0 | 5.0 | 5.0 | 5.0 | 5.0 | 5.0 | 5.0 | 5.0 | 4.2 | 4.0 | 4.6 | 3.2 | 3.3 | 2.7 |
| (1) ABS base material damaging property | ○ | ○ | ○ | ○ | ○ | ○ | ○ | ○ | ○ | ○ | ○ | X | X | X |

Examples 17 to 25, and Comparative Examples 13 to 18

The components shown in Table 3 were used to prepare liquid detergents (surfactants) for bathtubs in Examples 17 to 25 and Comparative Examples 13 to 18. The pH value was adjusted with sodium hydroxide or hydrochloric acid. As the glyceryl-ether as component (a), a mixture of Compounds 1 to 5 above was used. In the tables, dodecyl trimethyl ammonium chloride was used as Cation A, and octyl benzyl dimethyl ammonium chloride was used as Cation B.

The respective liquid detergent compositions thus prepared were evaluated for their property of damaging the base material (ABS resin damage) and for their detergency towards soap scums, according to the evaluation methods (1) and (3) described above. Further, the following evaluation methods were used for additional evaluation: the evaluation method (4) for evaluation of sebum smear detergency, the evaluation method (5) for evaluation of scale smear detergency, and the evaluation method (6) for soap scum detergency (No. 2) evaluation without rubbing the smears. The results are shown in Table 3.

Evaluation Method (4)

<Detergency Towards Sebum Smear>

Ten adult men bathed in a usual manner in an enameled bathtub containing 400 L warm water, and the bathtub was left overnight. Thereafter, the water was removed, the smears adhering to the bathtub were regarded as sebum smears. The smears were lightly rubbed 5 times with a polyurethane sponge impregnated with the prepared liquid detergent composition, and removal of the smears from the surface of the bathtub was evaluated visually according to the following criteria. The same evaluation was repeated 10 times and the average was shown in the table.

5: Very excellent cleaning

4: Excellent cleaning

3: Incomplete cleaning

2: Slight cleaning

1: Little cleaning

Evaluation Method (5)

<Detergency Towards Scale Smears>

Six adult men bathed subsequently for 15 minutes for each person in a stainless steel bathtub containing 200 L water at 40° C. and after the water was removed, the bathtub was left for 1 day. 3 ml of the liquid detergent composition in a commercial sprayer was sprayed onto the scale smears adhered to an water-swallowing part on the inside of the bathtub, left for 2 minutes and washed with water, and the degree of cleaning thereafter was evaluated according to the following criteria. The same evaluation was repeated 10 times and the average was shown in the table.

5: Very excellent cleaning

4: Excellent cleaning

3: Incomplete cleaning

2: Slight cleaning

1: Little cleaning

TABLE 3

| | Examples | | | | | | | | | Comparative Examples | | | | | |
|---|---|---|---|---|---|---|---|---|---|---|---|---|---|---|---|
| | 17 | 18 | 19 | 20 | 21 | 22 | 23 | 24 | 25 | 13 | 14 | 15 | 16 | 17 | 18 |
| Compound 1 (n-C5) | | | 2 | 2 | 1 | | 1 | | | | 3 | | | | |
| Compound 2 (3i-C5) | | | | | 1 | 1 | 1 | | 2 | | | | | | |
| Compound 3 (2i-C5) | | | 1 | 1 | | | 1 | 2 | 2 | | | | | | |
| Compound 4 (n-C4) | 2 | 2 | | | | 1 | | | | 3 | | | | | |
| Compound 5 (n-C6) | 1 | 1 | | | 1 | 1 | | 1 | 1 | | | 3 | | | |
| Diethylene glycol butyl ether | | | | | | | | | | | | | 3 | | 2 |
| Dipropylene glycol ethyl ether | | | | | | | | | | | | | | 3 | 1 |
| Cation A | 2 | | | | | 1 | | | | | | | | | |
| Cation D | | | 1 | 2 | 2 | 1 | 2 | 1 | 1 | | | | | | |
| Polyoxyethylene (p = 4) lauryl ether sulfuric acid sodium salt | 1 | 2 | 2 | 1 | | | | 2 | | 2 | 2 | 2 | 1 | 1 | 2 |
| Alkyl (C12) glycoside (average condensation degree = 1.3) | 0.5 | 1 | 1 | 1 | 1 | 1 | 1 | 1 | 1 | 1 | 1 | 1 | | | 2 |
| Polyoxyethylene (4 mol) lauryl ether | 0.5 | 1 | | | 1 | 1 | 1 | 1 | 1 | 1 | 1 | 1 | 3 | 3 | |
| EDTA-4 Na | | 2 | | 2 | 2 | 3 | 2 | 2 | | 2 | 2 | | 2 | 2 | 2 |
| Citric acid | 5 | 2 | 5 | 2 | 2 | | 2 | 2 | 5 | 2 | 2 | 5 | 2 | 2 | 2 |
| Water | balance | balance | balance | balance | balance | balance | balance | balance | balance | balance | balance | balance | balance | balance | balance |
| pH (adjusted with HCl, NaOH) | 6 | 7 | 6 | 8 | 7 | 12 | 7 | 7 | 6 | 7 | 7 | 5 | 7 | 7 | 7 |
| (4) Sebum smear detergency | 5.0 | 4.5 | 5.0 | 5.0 | 5.0 | 5.0 | 5.0 | 5.0 | 5.0 | 4.0 | 4.0 | 4.1 | 2.3 | 2.2 | 2.2 |
| (3) used-soap smear detergency | 5.0 | 4.5 | 5.0 | 5.0 | 5.0 | 5.0 | 5.0 | 5.0 | 5.0 | 4.0 | 4.0 | 4.1 | 2.1 | 2.0 | 2.1 |
| (5) Scale smear detergency | 4.2 | 4.1 | 4.3 | 4.3 | 4.8 | 4.8 | 4.3 | 4.6 | 4.9 | 3.8 | 3.9 | 4.0 | 1.9 | 1.8 | 1.8 |
| (6) used-soap smear detergency (No. 2) | 4.2 | 4.1 | 4.4 | 4.3 | 4.7 | 4.7 | 4.3 | 4.6 | 4.9 | 3.8 | 3.9 | 4.0 | 1.9 | 1.7 | 1.7 |
| (1) ABS base material damaging property | ○ | ○ | ○ | ○ | ○ | ○ | ○ | ○ | ○ | ○ | ○ | ○ | X | X | X |

Evaluation Method (6)

<Detergency Towards Soap Scums (No. 2)>

A polyester FRP plate was placed in a conventional bathroom and left for 3 months without cleaning, and it was used as a smeared plate. Soap scums on the plate were hardly removed by rubbing them with a sponge and remained persistently. The smeared plate was fixed horizontally, and 3 ml of the liquid detergent composition in a commercial sprayer was sprayed onto it, left for 3 minutes, and washed with water, and the degree of cleaning was evaluated according to the following criteria. The same evaluation was repeated 10 times and the average was shown in the table.

5: Very excellent cleaning

4: Excellent cleaning

INDUSTRIAL APPLICABILITY

As described above, the liquid detergent composition of the present invention contains as the solvent a mixture of glyceryl-ethers represented by the formula (1). Accordingly the present composition has the novel and unique effect of exhibiting high detergency without damaging the styrene-based resin. The liquid detergent composition of the present invention is suitable as a detergent for use particularly in kitchens and bathrooms.

What is claimed is:

1. A liquid detergent composition comprising (a) 0.1 to 50% by weight of a mixture of at least two different compounds selected from glyceryl-ether compounds having the formula (I):

$$R—OCH_2CH(OH)CH_2OH \quad (I)$$

wherein R is an alkyl or alkenyl group having 4 to 6 carbon atoms, wherein two of said at least two different compounds (1) are structural isomers of one another, or (2) differ in the number of carbon atoms, (b) 0.01 to 30% by weight of a surfactant, (c) 0.01 to 30% by weight of a builder or an alkali agent and (d) the balance of water.

2. The composition as claimed in claim 1, wherein (b) contains a cationic surfactant.

3. The composition as claimed in claim 1, wherein (a) the mixture comprises two different glyceryl-ether compounds at a ratio ranging from 1:9 to 9:1.

4. The composition as claimed in claim 1, wherein (a) the mixture comprises at least two different compounds selected from the following glyceryl-ether compounds:

$CH_3CH_2CH_2CH_2CH_2$—$OCH_2CH(OH)CH_2OH$, $CH_3CH(CH_3)CH_2CH_2$—$OCH_2CH(OH)CH_2OH$, $CH_3CH_2CH(CH_3)CH_2$—$OCH_2CH(OH)CH_2OH$, $CH_3CH_2CH_2CH_2$—$OCH_2CH(OH)CH_2OH$, and $CH_3CH_2CH_2CH_2CH_2CH_2$—$OCH_2CH(OH)CH_2OH$.

5. The composition as claimed in claim 4, wherein (a) the mixture comprises $CH_3CH_2CH_2CH_2CH_2$—$OCH_2CH(OH)CH_2OH$, and $CH_3CH(CH_3)CH_2CH_2$—$OCH_2CH(OH)CH_2OH$.

6. The composition as claimed in claim 4, wherein (a) the mixture comprises $CH_3CH(CH_3)CH_2CH_2$—$OCH_2CH(OH)CH_2OH$, and $CH_3CH_2CH(CH_3)CH_2$—$OCH_2CH(OH)CH_2OH$.

7. The composition as claimed in claim 4, wherein (a) the mixture comprises $CH_3CH_2CH_2CH_2CH_2$—$OCH_2CH(OH)CH_2OH$, and $CH_3CH_2CH(CH_3)CH_2$—$OCH_2CH(OH)CH_2OH$.

8. The composition as claimed in claim 4, wherein (a) the mixture comprises $CH_3CH_2CH_2CH_2$—$OCH_2CH(OH)CH_2OH$, and $CH_3CH_2CH_2CH_2CH_2CH_2$—$OCH_2CH(OH)CH_2OH$.

9. The composition as claimed in claim 4, wherein (a) the mixture comprises $CH_3CH_2CH(CH_3)CH_2$—$OCH_2CH(OH)CH_2OH$, $CH_3CH_2CH_2CH_2$—$OCH_2CH(OH)CH_2OH$, and $CH_3CH_2CH_2CH_2CH_2CH_2$—$OCH_2CH(OH)CH_2OH$.

10. The composition as claimed in claim 4, wherein (a) the mixture comprises $CH_3CH_2CH_2CH_2CH_2$—$OCH_2CH(OH)CH_2OH$, $CH_3CH_2CH_2CH_2$—$OCH_2CH(OH)CH_2OH$, and $CH_3CH_2CH_2CH_2CH_2CH_2$—$OCH_2CH(OH)CH_2OH$.

11. The composition as claimed in claim 4, wherein (a) the mixture comprises $CH_3CH_2CH_2CH_2CH_2$—$OCH_2CH(OH)CH_2OH$, $CH_3CH(CH_3)CH_2CH_2$—$OCH_2CH(OH)CH_2OH$, and $CH_3CH_2CH_2CH_2CH_2CH_2$—$OCH_2CH(OH)CH_2OH$.

12. The composition as claimed in claim 4, wherein (a) the mixture comprises $CH_3CH(CH_3)CH_2CH_2$—$OCH_2CH(OH)CH_2OH$, $CH_3CH_2CH_2CH_2$—$OCH_2CH(OH)CH_2OH$, and $CH_3CH_2CH_2CH_2CH_2CH_2$—$OCH_2CH(OH)CH_2OH$.

13. The composition as claimed in claim 4, wherein (a) the mixture comprises $CH_3CH_2CH_2CH_2CH_2$—$OCH_2CH(OH)CH_2OH$, $CH_3CH(CH_3)CH_2CH_2$—$OCH_2CH(OH)CH_2OH$, and $CH_3CH_2CH(CH_3)CH_2$—$OCH_2CH(OH)CH_2OH$.

14. The composition as claimed in claim 4, wherein (a) the mixture comprises $CH_3CH_2CH(CH_3)CH_2$—$OCH_2CH(OH)CH_2OH$, and $CH_3CH_2CH_2CH_2CH_2CH_2$—$OCH_2CH(OH)CH_2OH$.

15. The composition as claimed in claim 4, wherein (a) the mixture comprises $CH_3CH(CH_3)CH_2CH_2$—$OCH_2CH(OH)CH_2OH$, $CH_3CH_2CH(CH_3)CH_2$—$OCH_2CH(OH)CH_2OH$, and $CH_3CH_2CH_2CH_2CH_2CH_2$—$OCH_2CH(OH)CH_2OH$.

16. A process for removing oil smears or soap scums from a hard body which comprises cleaning said hard body with the liquid detergent composition of claim 1.

17. The composition as claimed in claim 3, wherein the ratio ranges from 1:5 to 5:1.

* * * * *